US007874111B2

(12) United States Patent
Guldimann

(10) Patent No.: US 7,874,111 B2
(45) Date of Patent: Jan. 25, 2011

(54) FLOOR SYSTEM

(75) Inventor: Anton Guldimann, Schoftland (CH)

(73) Assignee: Wigasol AG, Niederbuchsiten (CH)

( * ) Notice: Subject to any disclaimer, the term of this patent is extended or adjusted under 35 U.S.C. 154(b) by 338 days.

(21) Appl. No.: 11/731,323

(22) Filed: Mar. 30, 2007

(65) Prior Publication Data

US 2007/0245642 A1 Oct. 25, 2007

(30) Foreign Application Priority Data

Apr. 7, 2006 (CH) ..... 0572/06

(51) Int. Cl.
*E04B 5/00* (2006.01)
*E02D 5/74* (2006.01)
*E02D 27/42* (2006.01)

(52) U.S. Cl. ..... 52/263; 52/155; 52/170

(58) Field of Classification Search ..... 52/299, 52/155–165, 263, 170, 650.3
See application file for complete search history.

(56) References Cited

U.S. PATENT DOCUMENTS 960,207 A * 5/1910 Slater ..... 52/92.2
1,746,668 A * 2/1930 McGarraugh ..... 52/299
2,129,211 A * 9/1938 Hickl ..... 52/294
3,203,145 A * 8/1965 Raynes ..... 52/22
3,797,260 A * 3/1974 Webb ..... 405/172
3,832,811 A * 9/1974 Briel, Jr. ..... 52/69
3,866,368 A * 2/1975 Toops ..... 52/162
4,012,871 A * 3/1977 Netto et al. ..... 52/79.4
4,221,090 A * 9/1980 Pahl ..... 52/169.9
4,348,841 A * 9/1982 Ueno et al. ..... 52/126.5
4,416,715 A * 11/1983 Schramm et al. ..... 156/210
4,622,792 A * 11/1986 Betts ..... 52/263
5,079,890 A * 1/1992 Kubik et al. ..... 52/649.1
5,212,919 A * 5/1993 Shaw et al. ..... 52/126.6
5,301,485 A * 4/1994 Shaw et al. ..... 52/678
5,367,845 A * 11/1994 Hartling ..... 52/293.1
5,787,663 A * 8/1998 Wehrmann ..... 52/263
D398,279 S * 9/1998 Wagner ..... D12/215
5,850,715 A * 12/1998 Francis ..... 52/155

(Continued)

FOREIGN PATENT DOCUMENTS

CH 695 736 A5 8/2006

(Continued)

OTHER PUBLICATIONS

European Search Report dated Dec. 10, 2008 issued in connection with counterpart European Patent Application No. EP 06 40 5484 and English translation thereof (8 pages).

(Continued)

*Primary Examiner*—Richard E Chilcot, Jr.
*Assistant Examiner*—Andrew J Triggs
(74) *Attorney, Agent, or Firm*—Holtz, Holtz, Goodman & Chick, P.C.

(57) ABSTRACT

A floor system for use in a conservatory or other annexes includes a panelled floor and a frame construction. The frame construction at least partly surrounds the panelled floor. The floor system is anchored in the ground by at least one ground anchor. The use of ground anchors makes a prior excavation substantially completely unnecessary. The floor system is a dry construction system, in which no construction material containing water are used during construction of the floor system.

17 Claims, 1 Drawing Sheet

U.S. PATENT DOCUMENTS

| | | | | | |
|---|---|---|---|---|---|
| 5,875,592 | A * | 3/1999 | Allman et al. | 52/90.2 |
| 6,082,070 | A * | 7/2000 | Jen | 52/650.3 |
| 6,128,880 | A * | 10/2000 | Meenan, Jr. | 52/489.1 |
| 6,131,350 | A * | 10/2000 | Sanders | 52/293.1 |
| 6,141,927 | A * | 11/2000 | Usui | 52/263 |
| 6,314,693 | B1 * | 11/2001 | Sanders | 52/294 |
| 6,324,801 | B1 * | 12/2001 | Holfman et al. | 52/299 |
| 6,550,201 | B2 * | 4/2003 | Hoffman et al. | 52/299 |
| 6,609,346 | B2 * | 8/2003 | Hoffman et al. | 52/741.15 |
| 6,718,711 | B1 * | 4/2004 | Gilman | 52/299 |
| 6,745,528 | B2 * | 6/2004 | Morita et al. | 52/263 |
| 6,751,923 | B1 * | 6/2004 | Nunley | 52/783.19 |
| 6,755,001 | B2 * | 6/2004 | Eaton | 52/506.06 |
| 6,764,251 | B1 * | 7/2004 | Schnur | 405/224 |
| 6,983,570 | B2 * | 1/2006 | Mead | 52/263 |
| 7,028,435 | B2 * | 4/2006 | Walker et al. | 52/236.5 |
| D567,323 | S * | 4/2008 | Aagerup | D21/840 |
| 2001/0025465 | A1 * | 10/2001 | Osfolk | 52/650.3 |
| 2007/0245642 | A1 * | 10/2007 | Guldimann | 52/126.5 |
| 2007/0261323 | A1 * | 11/2007 | Hubbard et al. | 52/167.6 |

FOREIGN PATENT DOCUMENTS

| | | | |
|---|---|---|---|
| DE | 195 38 366 | A1 | 4/1997 |
| DE | 199 21 837 | A1 | 9/2000 |
| DE | 20 2004 010 693 | U1 | 9/2004 |
| WO | WO 2004/094751 | A2 | 11/2004 |

OTHER PUBLICATIONS

Partial European Search Report dated Sep. 26, 2008 issued in connection with counterpart European Patent Application No. EP 06 40 5484 and English translation thereof.

* cited by examiner

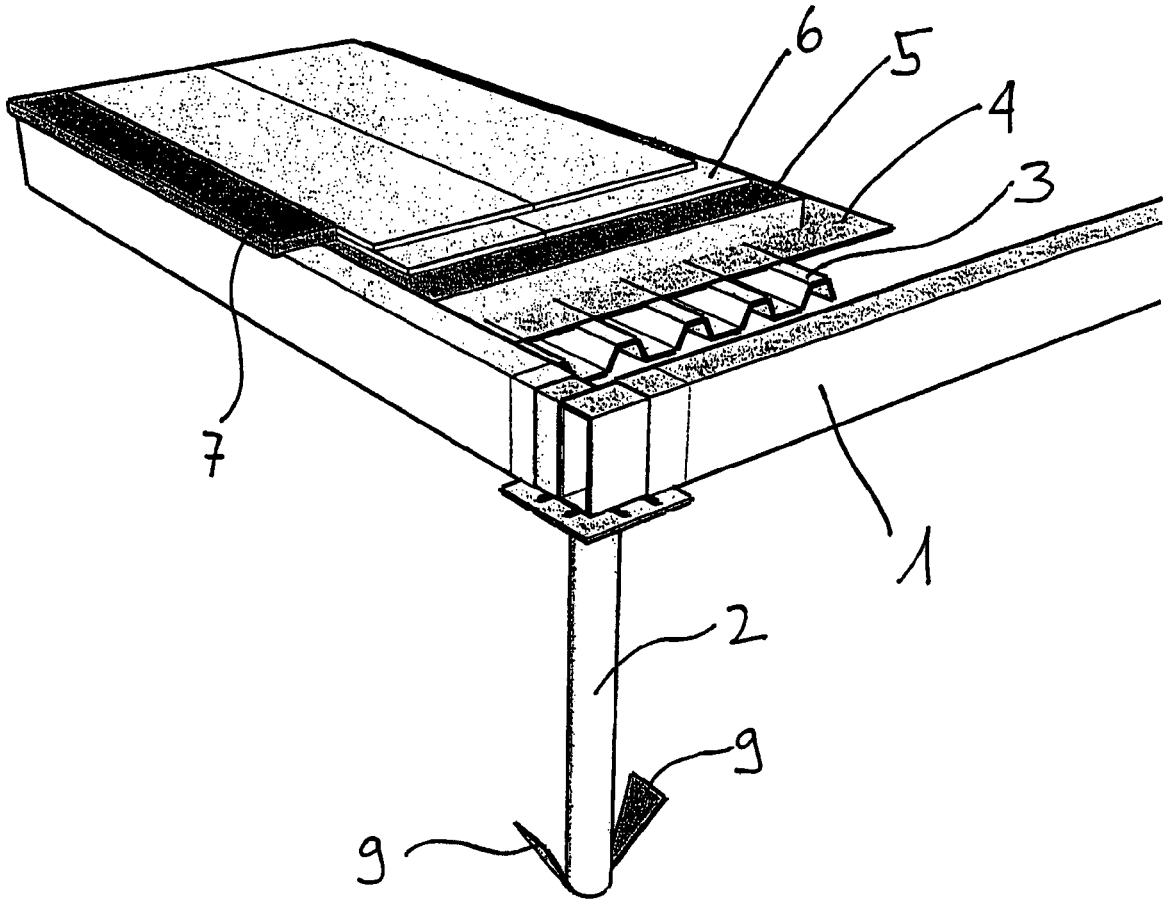
6
5
4
3
7
1
2
9
9

FLOOR SYSTEM

CROSS REFERENCE TO RELATED APPLICATION

This application claims the benefit under 35 USC 119 of Swiss Patent Application No. 572/06 filed Apr. 7, 2006, the entire disclosure of which is incorporated herein by reference.

FIELD OF THE INVENTION

The invention is in the field of floor systems, in particular floor systems for conservatories and other extensions of buildings and/or small buildings according to the generic term of the independent patent claim.

BACKGROUND INFORMATION

In the domain of e.g. conservatories systems are known for which relatively extensive concrete foundations are required. This is correspondingly elaborate and costly. In this regard improved floor systems are now known from CH 695 736, in which only punctual foundations at the corners of the floor are required, such that only small areas need to be excavated. The floor system presented in this document additionally comprises a steel frame and a floor panel which is thermally and statically independent thereof. Thus thermal insulation of the floor is simplified and cracking fissuration due to different expansions is prevented.

This floor system, however, is disadvantageous in so far that excavations for concrete foundations are still necessary.

SUMMARY OF THE INVENTION

Starting from the described state of the art the object is to create a floor system, the installation of which involves no or only minor excavations.

This object is achieved by the invention as defined in the claims.

The invention is based on the replacement of concrete foundations by ground anchors. The ground anchors comprise anchoring elements by which the anchor is substantially retained in the ground, e.g. soil, essentially by means of positive engagement.

As the anchors may be driven into the ground, a preceding excavation is completely or at least largely unnecessary.

A further advantage of the use of ground anchors is that they do without a joining compound, such as e.g. concrete, cement etc. Joining compounds require a certain time for desiccation or hardening respectively. This time can be saved. Furthermore conventional joining compounds are usually based on water and where necessary other bonding agents which may only be used within a certain temperature range. The working of concrete is e.g. not or only inadequately possible at temperatures below zero degrees Celsius. The floor system according to the invention may, however, due to the use of concrete anchors, be installed in any weather, in particular also under permafrost.

In a preferred embodiment, which comprises a panelled floor and a frame structure, said frame structure surrounding the panelled floor at least partly, no building materials containing water are used for the complete floor system including the panelled floor, such that the floor may be constructed in any weather, in particular also under permafrost.

The panelled floor of conventional floors comprises a concrete underlay, which is cast and desiccated before the floor panels are positioned. In a preferred embodiment the panelled floor is replaced by a dry construction system, which advantageously comprises prefabricated individual panels or a multi-layer prefabricated floor panel. Such a panel may e.g. be or comprise a dry concrete slab or a different kind of concrete bonded dry slab.

The construction of the system floor thus becomes largely independent of the prevailing ambient temperature conditions and in particular of those in the floor itself. In addition, excavation is restricted to a moderate depth for the frame construction and where necessary for the floor panel positioned in it.

A panelled floor or a floor panel respectively mainly serves statics over the complete floor and insulation and comprises a corresponding insulating layer. A floor panel is advantageously insulated thermally against the frame construction and surrounding soil.

The frame construction substantially replaces a frost barrier and is statically independent of the rest of the floor construction. Thus a cracking fissuration caused by different expansions in the panelled floor, in particular in a concrete slab can be prevented.

A frame construction is advantageously designed to be circumferential to a floor panel, whereas the frame construction is fastened to at least one ground anchor and where necessary to a wall. The floor system is particularly suited to building extensions such as e.g. conservatories and winter gardens, but also for individual small buildings such as tool sheds, aviaries etc.

BRIEF DESCRIPTION OF THE DRAWING

In the following exemplified embodiments are described in more detail by means of a drawing.

In the FIGURE an embodiment of the inventive floor system is shown.

DETAILED DESCRIPTION

In the FIGURE a section of a floor system with a frame construction 1 and a panelled floor is shown. The frame construction can be a circumferential steel frame. At the corners of the steel frame a ground anchor is fixed to, e.g. bolted or welded. The panel construction, which substantially consists of a multi-layer floor panel, is partially or completely framed by the frame construction 1. In the present example the floor panel consists of the following layers: a profiled sheeting 3 (trapezoidal corrugations), a flat sheeting 4, an insulation 5, a multi-layer dry concrete slab 6. The multi-layer dry concrete slab is a prefabricated dry concrete slab unit and in this example consists of two conjoined, advantageously bonded or glued together, individual dry concrete slabs. The individual concrete slabs are offset in relation to one another in order to enlarge a bonding surface and to restrict a possible formation of fissures in joining areas to one single layer.

Individual layers or slabs respectively may be attached to one another, especially by means of bolting or riveting. This is advantageous carried out prior to the fitting or installing of the dry floor system. For this purpose e.g. the profiled sheeting is joined to the flat sheeting. Such a joining of individual slabs as well as the manufacture of slab systems is carried out before construction of the floor system, such that a dry slab system is formed, which, together with the frame construction and the ground anchors, forms a dry construction system. An uppermost (multi-layer) dry concrete slab is advantageously not connected to other elements such as other slabs or the frame, but laid out in a floating manner. This guarantees decoupling between frame and concrete floor.

The insulation 5 is advantageously a slab of polyurethane foam of several centimeters thickness, advantageously 3-8 cm, e.g. 6 cm. The dry concrete slab 6 is of a preferred thickness in the region of 1.5-5 cm, e.g. 2-4 cm, e.g. 2.5 cm.

It is also possible to use a sandwich-slab as floor panel as described in CH No. 695 736, where profiled sheeting, insulation, and flat sheeting form the sandwich-slab, i.e. the insulation and the flat sheeting are interchanged in relation to the present construction. It is, however, self-evident that insulating and stabilizing layers and panels may be arranged in different manner and if appropriate supplemented by further layers and/or replaced by other suitable materials.

Between the steel frame and the floor panel another insulation (not shown in the FIGURE) is advantageously inserted, e.g. an insulating strip of few millimeters to few centimeters thickness, e.g. 1 cm, to impede a thermal bridge. Furthermore a tolerance element 7 is loosely laid out on the steel frame, which tolerance element compensates tolerances e.g. of the floor, of the assemblies built onto the floor, e.g. a conservatory, and/or a building to which a conservatory is annexed. This kind of tolerance element is advantageously made of plastic or wood and additionally impedes a thermal bridge between frame and assembly.

The ground anchor 2 comprises two opposingly arranged anchoring elements 9 which are shovel-shaped or triangular. They are, with their wider side facing upwards, arranged laterally on a central tubular anchor element. These anchoring elements 9 retain the ground anchor in the soil and anchor the frame construction that is fixed to the ground anchor or to the several ground anchors and thus anchor the floor system. The ground anchor is advantageously made of metal, e.g. of steel and may, if required, also be fixed to a longitudinal side of the steel frame.

The anchoring elements may be arranged flexibly, such that, when positioning the ground anchor, e.g. by means of driving into the ground, e.g. into soil, they lie closely against the central elements and do not take up their strutted position until they have reached their final anchoring position. In a preferred embodiment of the ground anchor the anchoring elements are connected via a thread mechanism, e.g. a threaded rod, which leads through the central anchoring element, to the opposite ends of the anchor, which protrude out of the soil. A ground anchor is driven into the ground into a final position. Subsequently the anchoring elements are pressed outwards by means of the thread mechanism, so far that the ground anchor is anchored fast in the soil against traction.

Because an anchor even with its anchoring elements sticking out laterally, but in particular with its anchoring elements in resting position, demands a lot less spatial capacity than a concrete foundation, the excavation for the anchor with subsequent introduction of the anchor and filling up, excavation work is substantially less extensive.

It is also possible to arrange the anchoring elements in a sticking out position, e.g. in the final lateral position, before introducing the anchor in the ground. A subsequent compression of the ground can additionally contribute to the anchoring elements being surrounded with sufficient soil. It is, however, also possible to introduce a ground anchor further into the ground than the final anchoring position and to then draw the anchor back—possibly under rotation of the anchor—into the final position. The anchoring elements then grip into the soil as with a conventional ship's anchor.

The anchoring elements can also be distributed at different levels over the perimeter of the anchor, e.g. in a staggered manner. They are however arranged such that, in an installed condition of the anchor, they are completely introduced into the soil. The anchoring elements may be separate elements or in one piece with the anchor.

Having described exemplary embodiments of the invention with reference to the accompanying drawing, it will be appreciated that the present invention is not limited to those embodiments, and that various changes and modifications can be effected therein by one of ordinary skill in the art without departing from the scope or spirit or the invention as defined by the appended claims.

The invention claimed is:

1. A floor system for use in a conservatory comprising:

a panelled floor, wherein the panelled floor is a dry slab system and comprises a floor panel comprising an insulation and a dry concrete slab, a frame construction which at least partly surrounds the panelled floor, and at least one ground anchor for anchoring the frame construction to the ground.

2. The floor system according to claim 1, wherein the at least one ground anchor comprises a plurality of anchoring elements, which are arranged in a laterally protruding manner in relation to a longitudinal axis of the anchor.

3. The floor system according to claim 2, wherein the plurality of anchoring elements are arranged at the bottom end of the ground anchor and are shovel-shaped.

4. The floor system according to claim 3, wherein the plurality of anchoring elements are arranged flexibly, such that they are only brought into their final anchoring position, when the ground anchor is installed.

5. The floor system according to claim 2, wherein the plurality of anchoring elements are arranged flexibly, such that they are only brought into their final anchoring position, when the ground anchor is installed.

6. The floor system according to claim 1, wherein the panelled floor comprises a floor which is thermally insulated from the frame construction and surrounding soil.

7. The floor system according to claim 1, wherein the panelled floor is thermally insulated from the frame construction and surrounding soil.

8. The floor system according to claim 1, wherein the panelled floor and the frame construction are statically insulated from one another.

9. The floor system according to claim 1, wherein the frame construction surrounds and does not underlie or overlie the panelled floor.

10. The floor system according to claim 1, wherein the frame construction is a circumferential frame, the panelled floor being situated completely within an inner periphery of the circumferential frame.

11. The floor system according to claim 1, wherein the panelled floor comprises a dry concrete slab, the dry concrete slab not being connected to the frame construction such that the dry concrete slab floats relative to the frame construction.

12. The floor system according to claim 1, wherein the panelled floor comprises a dry concrete slab, the dry concrete slab not being connected to the frame construction such that the dry concrete slab is decoupled from the frame construction.

13. The floor system according to claim 1, further comprising thermal insulation which insulates the panelled floor from the frame construction.

14. The floor system according to claim 1, wherein the at least one ground anchor comprises at least one anchoring element, each of the at least one anchoring element being attached to a respective corner of the frame construction.

15. A floor system for use in a conservatory comprising:

a panelled floor, a frame construction which at least partly surrounds the panelled floor, and at least one ground anchor for anchoring the frame construction to the ground, wherein the panelled floor is a dry slab system having a floor panel comprising an insulation and a dry concrete slab, wherein the floor panel is thermally insulated from the frame construction and surrounding soil, and wherein the floor panel and the frame construction are statically insulated from one another.

16. A method for construction of a floor system for use in a conservatory, comprising the steps of:

introducing at least one ground anchor into the ground without prior excavation for the ground anchor, fitting a frame construction to the at least one ground anchor, and introducing a panelled floor into the frame construction, such that said frame construction at least partly surrounds the panelled floor, wherein the panelled floor is a dry slab system and comprises a floor panel comprising an insulation and a dry concrete slab.

17. The method according to claim 16, wherein prefabricated slabs and layers are used only for construction of the panelled floor.

* * * * *